US005946940A

United States Patent [19]

Inoue

[11] Patent Number: 5,946,940

[45] Date of Patent: Sep. 7, 1999

[54] TANK AGGREGATE BODY OF RECEIVER TANK

[75] Inventor: Seiji Inoue, Konan, Japan

[73] Assignee: Zexel Corporation, Tokyo, Japan

[21] Appl. No.: 09/053,733

[22] Filed: Apr. 2, 1998

[30] Foreign Application Priority Data

Apr. 11, 1997 [JP] Japan ..... 9-110244

[51] Int. Cl.[6] ..... F25B 39/04

[52] U.S. Cl. ..... 62/509; 62/503; 62/512; 165/132

[58] Field of Search ..... 62/509, 503, 512; 165/132

[56] References Cited

U.S. PATENT DOCUMENTS 5,546,761 8/1996 Matsuo et al. ..... 62/509

5,713,217 2/1998 Baba ..... 62/509

*Primary Examiner*—Henry Bennett

*Assistant Examiner*—Mark Shulman

*Attorney, Agent, or Firm*—Wenderoth, Lind & Ponack, L.L.P.

[57] ABSTRACT

In a tank aggregate body for a receiver tank that achieves vapor/liquid separation of a coolant that has been liquefied at a condenser, a primary body wall portion is formed by rolling a plate material, bonding margins are formed at the two sides continuous to the primary body wall portion, a tank primary body is constituted from the primary body wall portion by abutting the bonding margins and the opening ends of the tank primary body are closed off with caps. A communicating passage for coolant inflow or coolant outflow is formed between the bonding margins by creating a gap between them. By constituting such a receiver tank by press-forming a plate material, the need for separately forming the communicating passage at the receiver tank by using a separate member is eliminated, and the shape of the communicating passage can be varied freely by changing the mode for machining the plate material.

11 Claims, 6 Drawing Sheets

TANK AGGREGATE BODY OF RECEIVER TANK

BACKGROUND OF THE INVENTION

1. Field of the Invention

The present invention relates to a structure of a tank used as a receiver tank employed in a cooling cycle and, in particular, it relates to a tank aggregate body in which a communicating portion communicates between the inside and the outside of the receiver tank and the tank primary body, formed as an integrated unit of the tank primary body.

2. Description of the Related Art

Receiver tanks employed in a cooling cycle in the prior art include those that are constituted by forming a cylindrical tank primary body through deep drawing, forging or the like and closing off its open ends with caps and those that are constituted by cutting prefabricated pipe-shaped material to a specific length and closing off its opening portions at both ends with caps.

For instance, the receiver tank disclosed in Japanese Unexamined Patent Publication No. H-267478 is constituted of a cylindrical primary body and lids that cover both ends of the primary body and is directly mounted at the header pipe of a condenser. An indented portion is formed at the primary body of the receiver tank at a position that faces opposite the header tank so that this indented portion forms a coolant passage between the primary body and the header pipe, with a passage hole communicating with the lower portion of the coolant passage and a passage hole communicating with the upper portion of the coolant passage formed at the header pipe and the receiver tank to guide the coolant from the header pipe to the receiver tank via the coolant passage.

When a cylindrical tank primary body is formed through deep drawing, forging or the like or by cutting a pipe-shaped material, a piping or a separate member for communicating between the header pipe at the condenser and the receiver tank is required, necessitating extra work such as further machining the tank primary body.

In contrast, the receiver tank disclosed in Japanese Unexamined Patent Publication No. H2-267478 described above offers an advantage in that the coolant passage is formed at the time that the receiver tank is bonded to the header tank. However, since the coolant passage is formed between the header pipe and the receiver tank, the shape of the header pipe and the position at which the coolant passage is formed are subject to restrictions, thereby posing a problem in that a great degree of freedom in layout cannot be afforded.

SUMMARY OF THE INVENTION

Accordingly, an object of the present invention is to provide a tank aggregate body for a receiver tank that facilitates machining of the receiver tank and achieves a greater degree of freedom in the formation of the communicating passage and a greater degree of freedom in mounting the receiver tank.

In order to achieve the object described above, the tank aggregate body for a receiver tank according to the present invention is constituted by forming a primary body wall portion by press-forming a plate material, forming bonding margins at the two sides continuous to the primary body wall portion constituted of the plate material, constituting a tank primary body with the primary body wall portion by abutting the bonding margins, closing off the opening ends of the tank primary body with caps and forming communicating passages for coolant inflow or coolant outflow at gaps between the abutted bonding margins.

When constituting the tank primary body with the primary body wall portion by abutting the bonding margins, a single sheet of plate material may be employed or two sheets of plate material may be employed in combination. When the tank primary body is to be constituted of a single sheet of plate material, the bonding margins formed at the two sides of the plate material are abutted to each other by rolling the plate material. For instance, if only the bonding margins and the primary body wall portion are to be formed with the plate material, the bonding margins should be simply formed along the side edges of the plate material, whereas if the entirety or a portion of the header tank of the condenser is to be formed at the same time, the wall portion of the header main body should be also formed continuous to and extending beyond the bonding margins. In addition, if two sheets of plate material are to be used to constitute the tank primary body, a primary body wall portion should be formed at each sheet of plate material with bonding margins formed at the two sides thereof, and by abutting the two sheets of plate material at their bonding margins, the tank primary body can be constituted of the primary body wall portions that face opposite each other.

Communicating passages to be formed at the bonding margins may be constituted by forming distended portions at the bonding margins of the plate material in advance so that gaps are created between the bonding margins by the distended portions when the bonding margins are abutted to each other. In order to achieve this with ease, distended portions for constituting the curves of the tank primary body and the communicating passages of the tank primary body should be formed by press-forming the plate material.

The communicating passages at the receiver tank may be either directly inserted and bonded at a connecting hole formed at the header tank of the condenser or fitted with a connector for connection. In addition, the communicating passages formed at the bonding margins may be made long in order to meet specific requirements, and in such a case, the bonding margins should be made correspondingly wide. Furthermore, only one communicating passage either for coolant inflow or coolant outflow may be formed, or communicating passages for both coolant inflow and coolant outflow may be formed at the bonding margins.

Since the receiver tank has a function of separating the coolant into vapor and liquid, a communicating passage for coolant inflow provided between the bonding margins should be formed connected to the upper portion of the tank primary body, whereas it is desirable to form a communicating passage for coolant outflow connected to the lower portion of the tank primary body.

The structure described above makes it possible to form the coolant communicating passages for the tank aggregate body of a receiver tank at the time of the formation of the tank primary body by machining a plate material, which eliminates the necessity for separately forming communicating passages at the receiver tank with separate members. In addition, since the shape of the coolant passages can be varied with a great degree of freedom in correspondence to various modes of plate material machining, the connecting modes for the header pipe and the receiver tank, too, can be diverse.

BRIEF DESCRIPTION OF THE DRAWINGS

The above and other features of the invention and the concomitant advantages will be better understood and appreciated by persons skilled in the field to which the invention pertains in view of the following description given in conjunction with the accompanying drawings which illustrate preferred embodiments. In the drawings.

DETAILED DESCRIPTION OF THE PREFERRED EMBODIMENTS

Figure 1A:
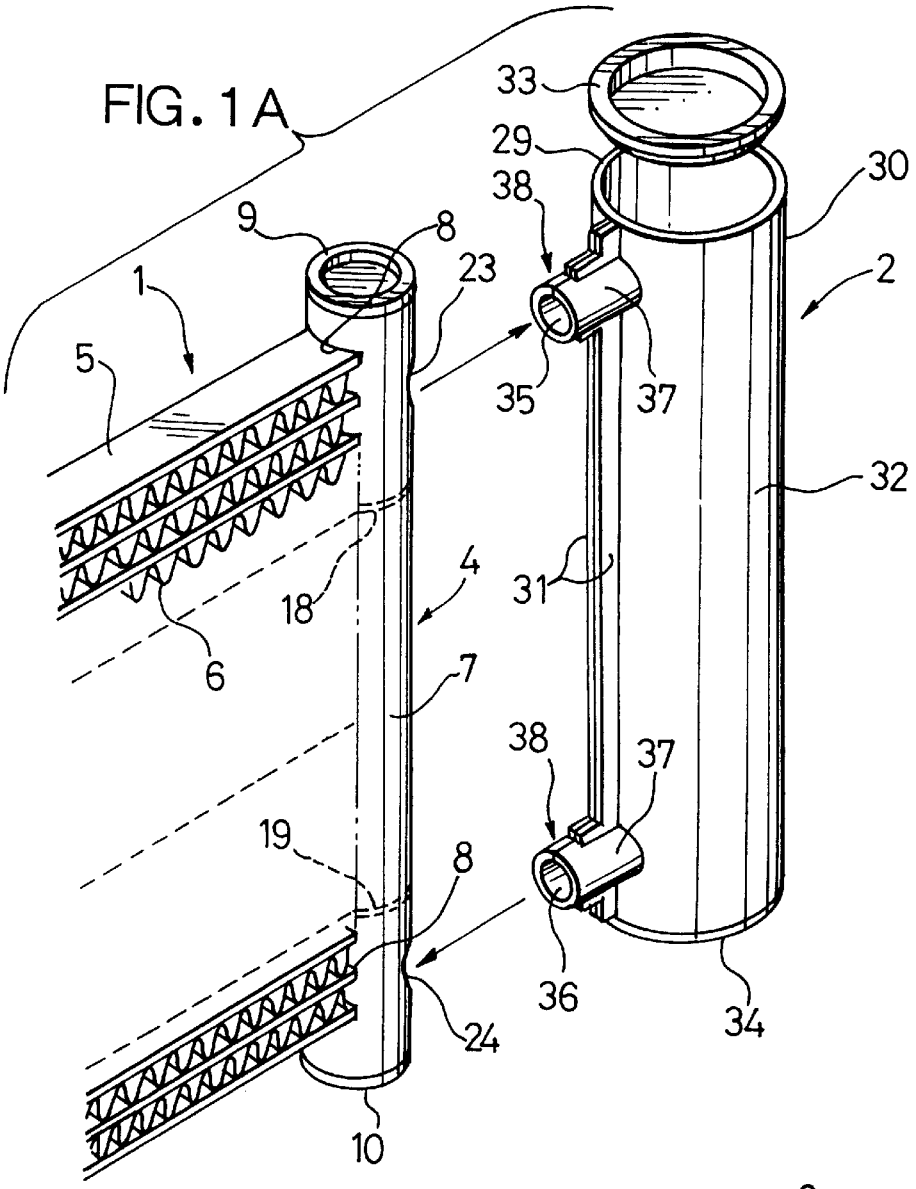
FIG. 1 illustrates a first structural example of the receiver tank according to the present invention, with FIG. 1A presenting a perspective illustrating a mode of mounting the receiver tank at a condenser as an integrated part and FIG. 1B illustrating the flow of the coolant through the condenser and the receiver tank.

The following is an explanation of preferred embodiments of the present invention in reference to the drawings. In FIG. 1, which shows a condenser 1 that constitutes a portion of the cooling cycle and a receiver tank 2 which is assembled as an integrated portion of the condenser 1. The condenser 1 is provided with a pair of header tanks 3 and 4 at positions that correspond with each other, a plurality of flat tubes 5 that communicate between the pair of header tanks 3 and 4 and corrugated fins 6 inserted and bonded between the individual flat tubes 5. In a normal configuration, the header tanks 3 and 4 are placed to extend vertically in the figures so that air flowing in a direction normal to the surface of the drawing paper, passes between the fins 6.

The header tanks 3 and 4 are each provided with a cylindrical header main body 7 which is formed through extrusion molding or by cutting a prefabricated pipe-shaped member to a specific length, with a plurality of insertion holes 8 formed at the header main body 7 so that the flat tubes 5 are inserted and bonded at the insertion holes 8, and the opening portions of the header main body 7 at the two ends are closed off by caps 9 and 10.

In one of the header tanks, i.e., the header tank 3, its internal space is divided into a first flow passage chamber through a third flow passage chamber 13~15 by a first partitioning wall 11 and a second partitioning wall 12 that are inserted from the outside. In other words, the space enclosed between the upper cap 9 and the first partitioning wall 11 constitutes the first flow passage chamber 13, the space enclosed between the lower cap 10 and the second partitioning wall 12 constitutes the third flow passage chamber 15 and the space enclosed between the first partitioning wall 11 and the second partitioning wall 12 constitutes the second flow passage chamber 14. In addition, an intake portion 16, which communicates with the second flow passage chamber 14 and an outlet portion 17, which communicates with the third flow passage chamber 15 are formed at the header main body 7.

In the other header tank, i.e., the header tank 4, its internal space is divided into a fourth flow passage chamber through a sixth flow passage chamber 20~22 by a third partitioning wall 18 and a fourth partitioning wall 19 that are inserted from the outside. The space enclosed between the upper cap 9 and the first partitioning wall 18 constitutes the fourth flow passage chamber 20, the space enclosed between the lower cap 10 and the fourth partitioning wall 19 constitutes the sixth flow passage chamber 22 and the space enclosed between the third partitioning wall 18 and the fourth partitioning wall 19 constitutes the fifth flow passage chamber 21. A connecting hole 23 which opens into the fourth flow passage chamber 20 and a connecting hole 2 4 which opens into the sixth flow passage chamber 22 are formed at the header main body 7 of the header tank 4, with an inflow side commu nicating passage and an outflow side communicating passage at the receiver tank 2 which are to be detailed later connected to the connecting holes 23 and 24, respectively.

While the fourth partitioning wall 19 is formed at the same position as that at which the second partitioning wall 12 is formed (at the position at which the number of the flat tubes connected to the sixth flow passage chamber 22 is the same as the number of flat tubes connected to the third flow passage chamber 15), the third partitioning wall 18 is formed at a position that corresponds to approximately halfway between the cap 9 of the header tank 3 and the first partitioning wall 11 so that the first flow passage chamber 13 is formed larger than the second flow passage chamber 14 and so that the fifth flow passage chamber 21 is formed larger than the fourth flow passage chamber 20. This structure provides a main heat exchanging unit 25 at a position that is higher than the second and fourth partitioning walls 12 and 19 and a sub-heat exchanging unit 26 at a position lower than these partitioning walls in the condenser 1.

Coolant that has flowed in through the intake portion 16 enters the second flow passage chamber 14 at the header tank 3, travels through the flat tubes 5 (the flat tubes at the lower level of the main heat exchanger 25) connected to the flow passage chamber 14 to reach the fifth flow passage chamber 21 at the header tank 4, flows upward in the fifth flow passage chamber 21 before making a U-turn to flow through the flat tubes at the middle level and enters the first flow passage chamber 13 at the header tank 3. Then, the coolant flows upward in the first flow passage chamber 13, makes a U-turn and travels through the flat tubes at the upper level and enters the fourth flow passage chamber at the header tank 4. The coolant that has thus reached the fourth flow passage chamber 20 enters the sub-heat exchanging unit 26 via the receiver tank 2, reaches the third flow passage chamber 15 via the flat tubes 5 connected to the sixth flow passage chamber 22 and flows out from the third flow passage chamber 15 through the outlet portion 17.

Consequently, the coolant that flows into the condenser 1 is a high-temperature, high-pressure coolant that has been compressed at a compressor in the cooling cycle, and through heat exchange with the air passing between the fins 6 which it undergoes while passing through the flat tubes at the lower, middle and upper levels at the main heat exchanging unit 25, it becomes a low temperature, high-pressure liquid coolant. After it is separated into vapor and liquid at the receiver tank 2, it passes through the flat tubes 5 constituting the sub-heat exchanging unit 26 to undergo further heat exchange with the air passing through the fins 6 so that it becomes liquefied with a high degree of reliability.

The receiver tank 2 is constituted by press machining a single sheet of aluminum plate material 29, providing bonding margins 31 at two sides of the plate material 29, providing a primary body wall portion 30 between the bonding margins and forming a tank primary body 32 by abutting the bonding margins 31 at the two sides with each other to roll the entire sheet. The diameter of the tank primary body 32 is formed larger than the diameter of the header tank 4, and the opening portions at the two ends of the tank primary body 32 are closed off by caps 33 and 34 as in the header tanks.

At the bonding margins 31 that are abutted to each other, communicating passages 35 and 36 are formed at two positions, i.e., at an upper position and at a lower position. The upper communicating passage is constituted as a coolant inflow communicating passage, whereas the lower communicating passage is constituted as a coolant outflow communicating passage. These communicating passages 35 and 36 are constituted by forming gutter-shaped portions 37 by distending the bonding margins 31 in a gutter shape and forming pipe portions 38 whose cross section is circular with the gutter-shaped portions 37 that face opposite each other when the bonding margins 31 at the two sides are abutted. These pipe portions 38 are formed projecting out in the direction of the radius of the tank primary body 32, and the excess connecting margins are removed at the front ends of the pipe portions so that the front ends of the pipe portions can be inserted and bonded at the connecting holes 23 and 24 of the header tank.

It is to be noted that the plate material 29 described above that constitutes the receiver tank 2 should be clad with a brazing material in advance with a drying agent or the like and can be located at a specific position at the tank primary body.

The receiver tank 2 in the structure described above is assembled by forming the primary body wall portion 30 and the bonding margins 31 with a single sheet of plate material 29 by employing a method such as sequential pressing, forming gutter-shaped portions 37 at the bonding margins 31, rolling the primary body wall portion 30 to form the tank primary body 32, abutting the bonding margins 31 to form the communicating passages 35 and 36 and ensuring during the finishing process that the abutted bonding margins 31 do not spread. Then, the opening portions of the tank primary body 32 are closed off with the caps 33 and 34.

In addition, the condenser 1, too, is assembled by inserting the flat tubes 5 and the partitioning walls 11, 12, 18 and 19 at the header tanks 3 and 4 with the caps 9 and 10 fitted in at the opening portions of the header tanks 3 and 4 to close them off. Then, by inserting the pipe portions 38 of the receiver tank 2 at the connecting holes 23 and 24 at the header tank 4, securing the entire assembly with a jig or the like and brazing the assembly in a furnace, the caps 9, 10, 33 and 34 are bonded at the opening portions of the tanks 2, 3 and 4 without any gap, the bonding margins 31 at the tank primary body 32 are bonded tightly without a gap, with the communicating passages 35 and 36 remaining intact and the pipe portions 38 are bonded at the communicating holes 23 and 24 with a high degree of air tightness to form the condenser 1 and the receiver tank 2 as an integrated unit.

Since the tank primary body 32 of the receiver tank 2 is formed by press machining a single sheet of plate material 29 and the communicating passages 35 and 36 are formed at the bonding margins 31, it becomes possible to form the communicating passages 35 and 36 at the time of the press-forming, to eliminate the necessity of performing further machining after the formation of the tank primary body, such as adding the communicating passages, thereby greatly facilitating the machining of the receiver tank 2.

While the communicating passages 35 and 36 are formed simply by projecting the pipe portions 38 in the radial direction from the tank primary body 32, the communicating passages themselves may be formed in any shape whatsoever through pressing of the plate material 29, with the only restriction being that they must be provided at the bonding margins 31. The degree of freedom in formation, and the degree of freedom in layout of the communicating passages 35 and 36 and, consequently, the degree of freedom in layout of the header tank 4 and the receiver tank 2, are increased.

Figure 2A:
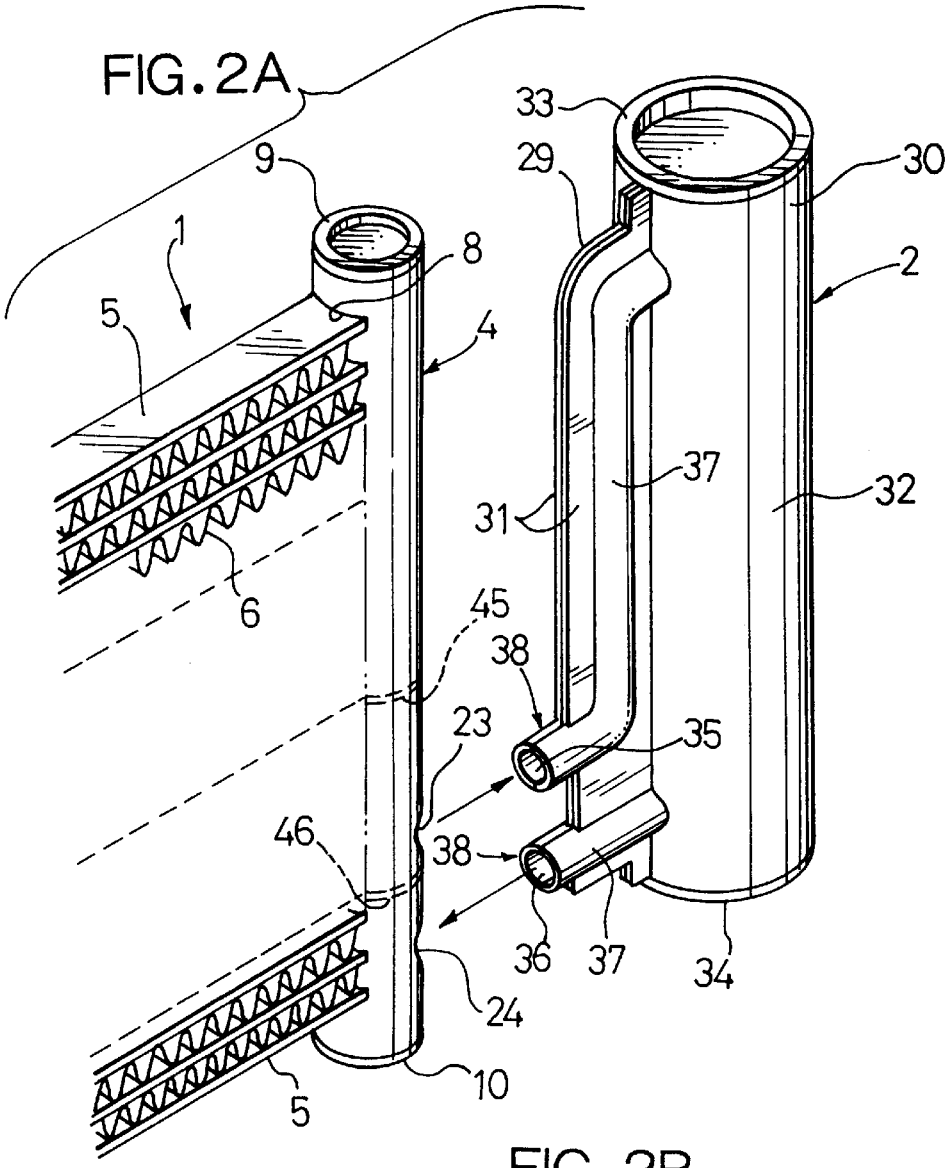
FIG. 2 illustrates a second structural example of the receiver tank according to the present invention, with FIG. 2A presenting a perspective illustrating a mode of mounting the receiver tank at a condenser as an integrated part and FIG. 2B illustrating the flow of the coolant through the condenser and the receiver tank.
Figure 2B:
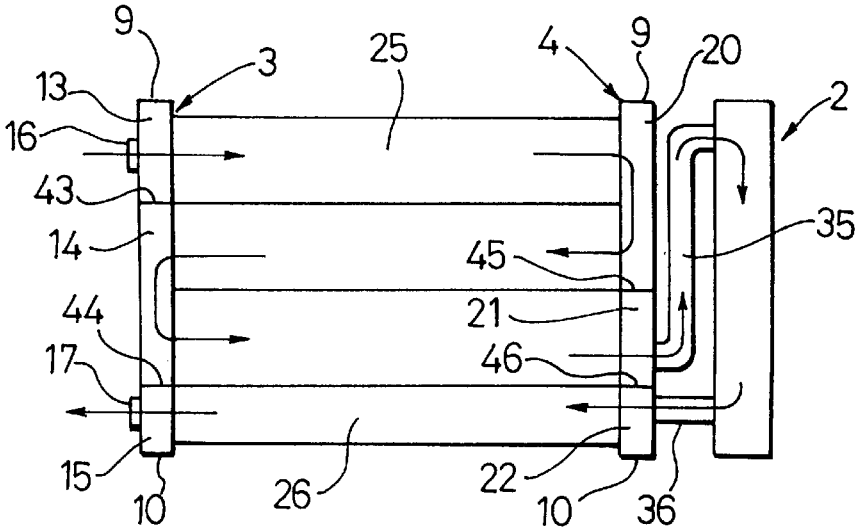

The shape of the communicating passages may be modified as in the receiver tank 2 illustrated in FIG. 2. In this receiver tank 2, the coolant inflow communicating passage 35 extends to the vicinity of the coolant outflow communicating passage 36 and, in correspondence to this, the connecting hole 23 of the header tank 4 at the condenser 1, too, is formed in the vicinity of the connecting hole 24.

Generally speaking, since, in the condenser 1, a high-temperature, high-pressure coolant gradually becomes liquefied while undergoing the process of heat exchange with the air passing through the condenser 1, it is desirable that the coolant flow from the upper portion toward the lower portion. In addition, in the receiver tank 2, too, it is necessary to guide the coolant from the upper portion to flow downward as in the previous structural example in order to promote the vapor/liquid separation. The structure illustrated in FIG. 2 satisfies these requirements.

In more specific terms, in the condenser 1, first through forth partitioning walls 43~46 at the header tanks 3 and 4 are provided at positions achieved by switching the left and right header tanks 3 and 4 in the previous structural example. Thus, while the second partitioning wall and the fourth partitioning wall are located at the same height, the first partitioning wall is provided at a position corresponding to a half-way position between the cap 9 of the header tank 4 and the third partitioning wall, so that the second flow passage chamber 14 is formed larger than the first flow passage chamber 13 and so that the fourth flow passage chamber 20 is formed larger than the fifth flow passage chamber 21. In addition, an intake portion 16 is formed at the first flow passage chamber 13, and a connecting hole 23 is formed at the fifth flow passage chamber 21.

In contrast, while the basic structure of the receiver tank 2 is similar to that in the previous structural example, the receiver tank 2 differs from that in the previous structural example in that the gutter-shaped portions 37 are formed ranging from the upper side toward the lower side at the area over which the width of the bonding margins is increased to constitute the inflow communicating passage 35. The inflow communicating passage 35 is inserted and bonded at the connecting hole 23 of the header tank 4, whereas the outflow communicating passage 36 is inserted and bonded at the connecting hole 24. It is to be noted that since other structural features are identical to those in the previous embodiment, the same reference numbers are assigned to identical components and their explanation is omitted.

Thus, coolant that has flowed in through the intake portion 16 at the condenser 1 enters the first flow passage chamber 13 at the header tank 3, travels through the flat tubes 5 (the flat tubes at the upper level of the main heat exchanger) connected to the flow passage chamber 13 to reach the fourth flow passage chamber 20 at the header tank 4, flows downward in the fourth flow passage chamber 20 before making a U-turn to flow through the flat tubes at the middle level and enters the second flow passage chamber 14 at the header tank 3. Then, the coolant flows downward in the second flow passage chamber 14, makes a U-turn, travels through the flat tubes 5 at the lower level and enters the fifth flow passage chamber 21 at the header tank 4. The coolant that has thus reached the fifth flow passage chamber 21 then travels through the communicating passage 35, is guided into the tank primary body 32 from the upper portion of the receiver tank 2 and falls to undergo vapor/liquid separation, then travels through the communicating passage 36 to enter the sub-heat exchanging unit 26, reaches the third flow passage chamber 15 via the flat tubes 5 connected to the sixth flow passage chamber 22 and flows out via the outlet portion 17 from the third flow passage chamber 15.

Figure 3A:
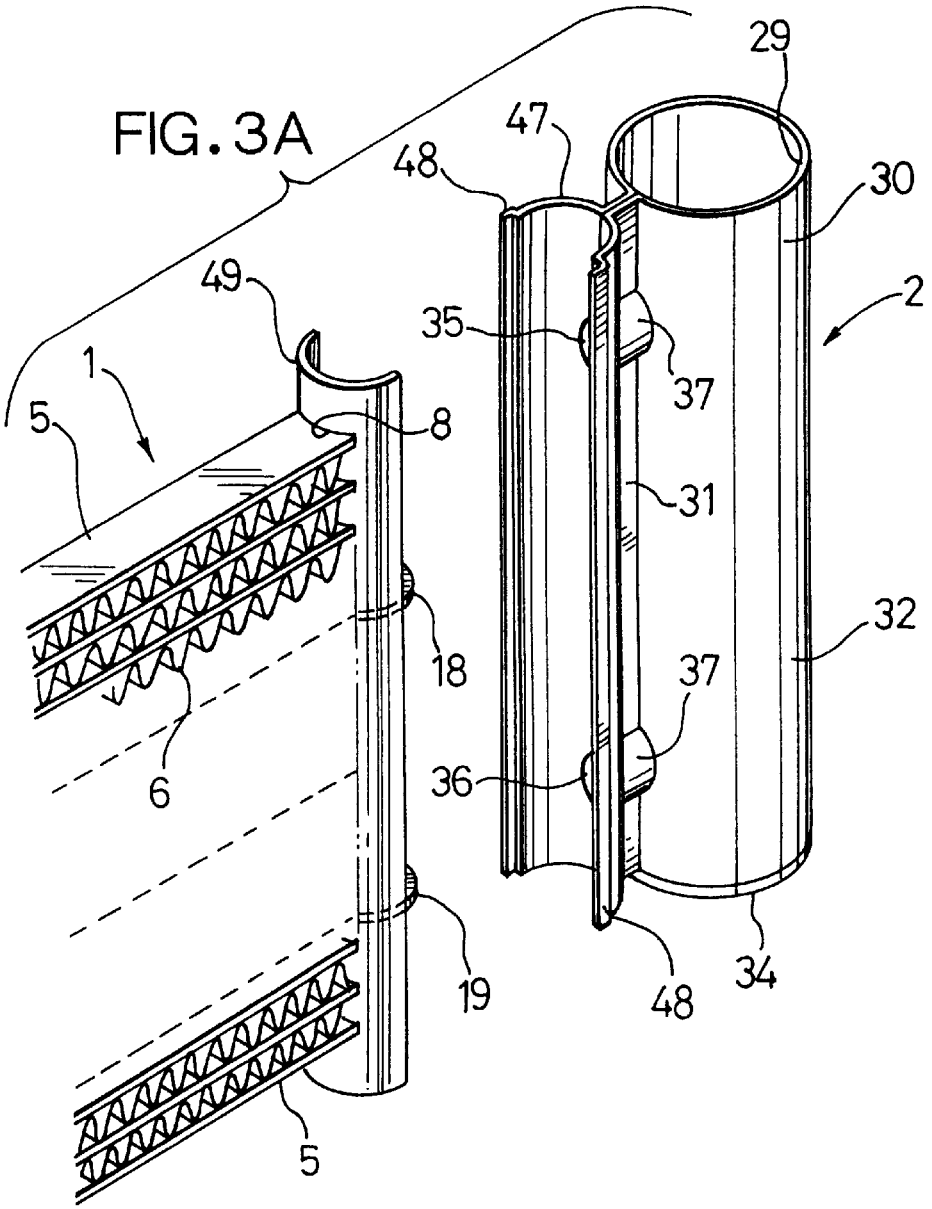
FIG. 3 illustrates a third structural example of the receiver tank according to the present invention, with FIG. 3A presenting a perspective illustrating a mode of mounting the receiver tank at a condenser as an integrated part and FIG. 3B presenting a plan view illustrating a state in which the condenser and receiver tank are assembled.
Figure 3B:
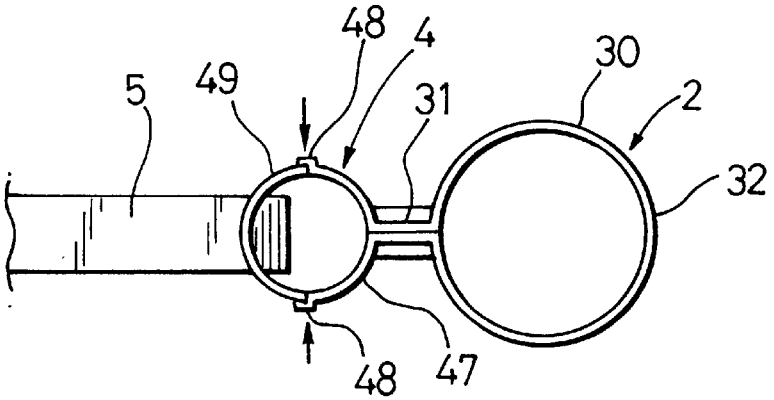

FIG. 3 shows another structural example in which the condenser 1 and the receiver tank 2 are formed as an integrated unit, and in this example, the plate material 29 which is to constitute the receiver tank 2 is also employed to constitute a portion of the header tank 4. Namely, the bonding margins 31 are formed at areas inward from the side edge portions of the plate material 29, and the side edge portions are machined through press machining to form a tank plate 47 whose cross section is in an arc shape to constitute approximately half of the outer wall of the header tank, with a staged portion provided at the front end of the arc shape and an enlarged caulking sheet for caulking 48 formed along the outside.

At the condenser 1, a tube insertion plate 49 whose cross section is in an arc shape with a plurality of insertion holes 8 at which the flat tubes 5 are to be inserted is provided, and the header main body of the header tank 4 is constituted by abutting the tube insertion plate 49 at the staged portion of the tank plate 47 and caulking the portion for caulking 48. Since the other structural features are identical to those in the previous embodiment, the same reference numbers are assigned to identical components and their explanation is omitted.

When achieving this structure, too, a single sheet of plate material 29 is rolled through a method such as sequential pressing to form the tank primary body 32, the primary body wall portion 30, the bonding margins 31, the gutter-shaped portions 37 and the tank plate 47 are formed as an integrated unit and then the opening portions of the tank primary body 32 are closed off with caps. In addition, at the condenser 1, too, the flat tubes 5 and the partitioning walls are inserted at one of the header tanks (not shown), the flat tubes 5 are inserted at the tube insertion plate 49 and the tank plate 47 and the tube insertion plate 49 are caulked and tightened together while placing the partitioning walls at specific positions to constitute the header tank 4. Then, the opening portions of the header tank 4 are closed off with caps, the entire assembly is secured with a jig or the like and brazing is performed on the assembly in that state in a furnace to form the condenser 1 and the receiver tank 1 as an integrated unit with the tank plate 47 and the tube insertion plate 49 bonded to each other so as to be completely watertight.

In this structure, since a portion of the header tank 4 is formed by press machining the plate material 29, the shape of the header tank 4 and the positions of the communicating passages 35 and 36 can be varied by employing different modes of machining to increase the degree of freedom in forming.

Figure 4A:
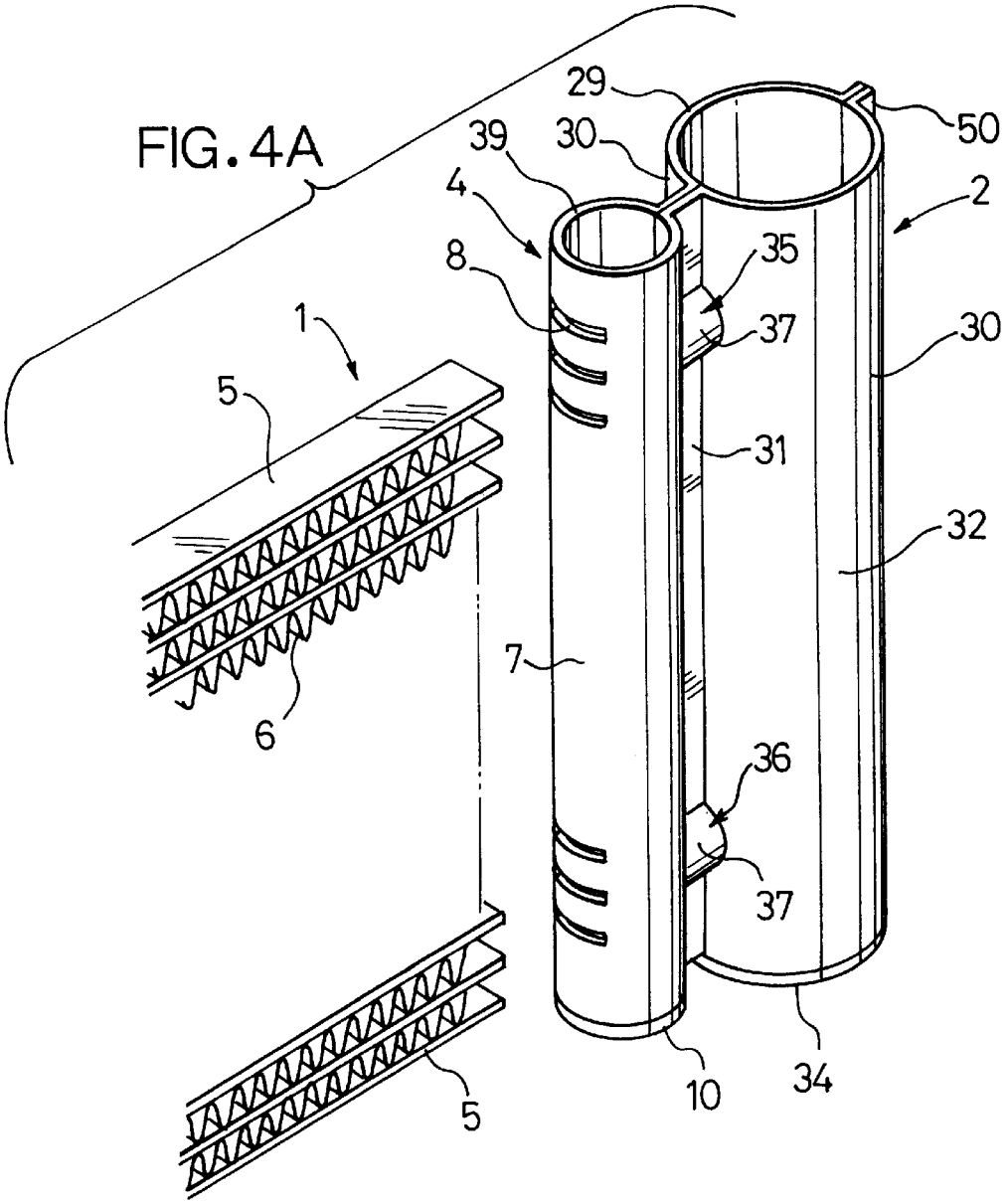
FIG. 4 illustrates a fourth structural example of the receiver tank according to the present invention, with FIG. 4A presenting a perspective illustrating a mode of mounting the receiver tank at a condenser as an integrated part and FIG. 4B presenting a plan view illustrating a state in which the condenser and receiver tank are assembled.
Figure 4B:
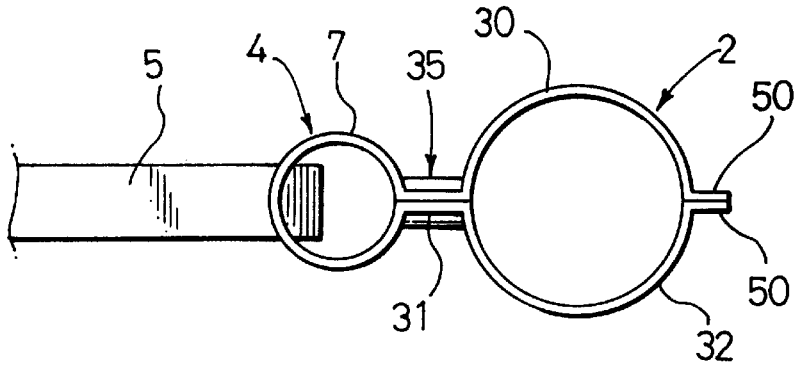

The header tank 4 may be machined in an integrated manner by using the plate material for forming the receiver tank 2 in the structure illustrated in FIG. 4, too. In this structure, a single sheet of plate material 29 is rolled to form the header main body 7 of the header tank 4 and the tank primary body 32 of the receiver tank 2 as an integrated unit. A header wall portion 39 is formed in a middle portion of the plate material 29, primary body wall portions 30 and 30 are formed closer to the two side portions, bonding margins 31 and 50 are formed at the two sides of both the primary body wall portions 30 of the plate material, i.e., between the primary body wall portions 30 and the header wall portion 39 and at the side portions of the plate material, and the header main body 7 of the header tank 4 is constituted by rolling the header wall portion 39, with the primary body wall portions 30 rolled into gutter shapes to constitute the tank primary body 32 of the receiver tank 2 with the primary body wall portions 30 and 30 that face opposite each other. Each bonding margin is bonded by being abutted to the corresponding bonding margin at the opposite side, and the gutter-shaped portions 37 described above are formed at the bonding margins 31 between the header main body 7 and the tank primary body 32 to constitute the coolant inflow communicating passage 35 and the coolant outflow communicating passage 36 that communicate between the header tank 4 and the receiver tank 2.

In order to achieve this structure, a single sheet of plate material 29 is machined to achieve the shape shown in FIG. 4 by employing a method such as sequential pressing and then the insertion holes 8 for inserting the flat tubes 5 are formed at the header tank 4. Then, the opening portions of the individual tanks are closed off with caps, the entire assembly is secured in a jig or the like with the flat tubes 5 and the partitioning walls inserted and brazing is performed in this state in a furnace to form the condenser 1 and the receiver tank 2 as an integrated unit. Thus, since the header main body 7 of one of the header tanks, i.e., the header tank 4 is formed at the time of the formation of the tank primary body 32 of the receiver tank 2, the number of required parts is reduced and, since the process for mounting the receiver tank 2 at the condenser 1 is no longer required, a reduction in the number of assembly steps is achieved.

While in all of the structural examples described above, the receiver tank 2 is formed at the condenser 1 as an integrated part, a connector 51 for piping connection may be provided at the communicating passages 35 and 36 formed at the bonding margins 31 in a structure in which the receiver tank 2 is provided near the condenser 1 through piping, as illustrated in FIG. 5.

Figure 5A:
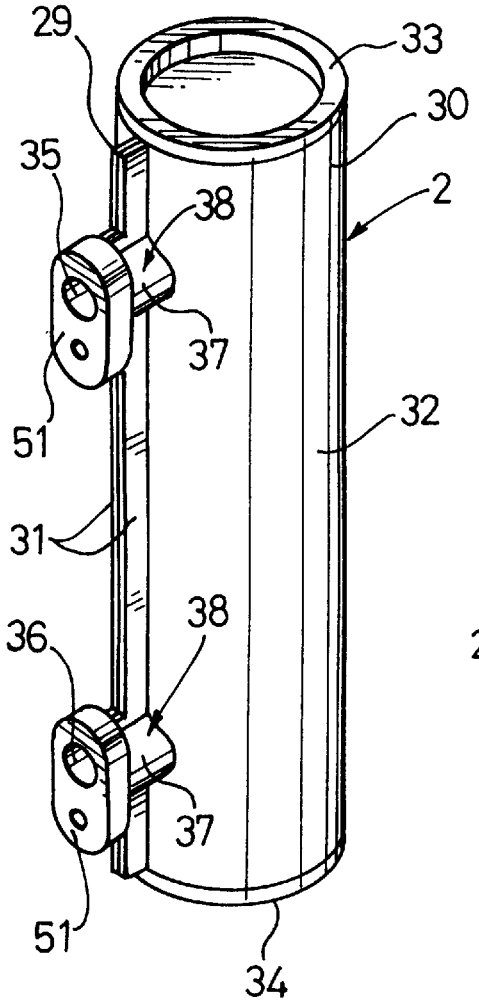
FIG. 5A illustrates a fifth structural example of the receiver tank according to the present invention in a perspective in which separate connectors are mounted to the communicating passages for coolant inflow and for coolant outflow and FIG. 5B illustrates a sixth structural example of the receiver tank according to the present invention in a cross section in which the front end portions of the individual communicating passage are placed together to correspond to the two communicating passages with a single connector.
Figure 5B:
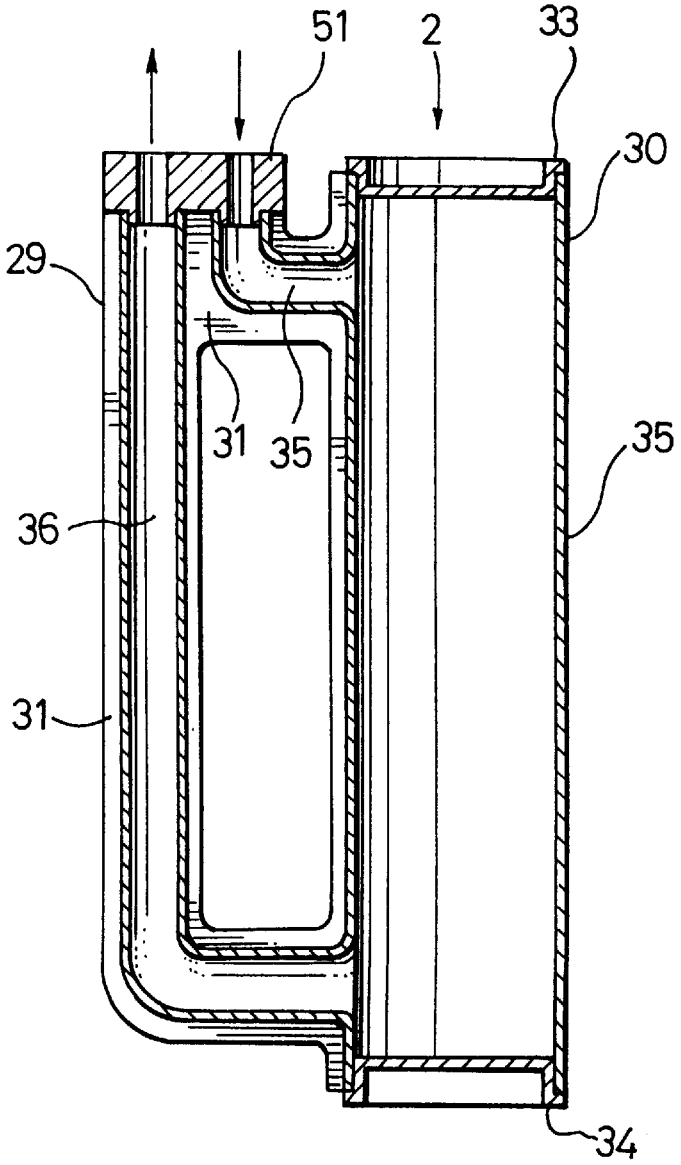

A number of different structures may be conceived for mounting the connector 51, depending upon the mounting position and the shape of the condenser. For instance, FIG. 5A shows separate connectors 51 bonded at the individual pipe portions 38 at the receiver tank 2 illustrated in FIG. 1, whereas in FIG. 5B, the coolant inflow/outflow communicating passages 35 and 36 are formed to open upward at a side of the receiver tank 2, with the opening ends of the communicating passages 35 and 36 located side by side at the upper end portion of the bonding margin 31, and one connector 51 which fits with the two communicating passages is bonded at the upper end portion of the bonding margin 31.

To achieve this receiver tank 2, the connector 51 is mounted at the communicating passages 35 and 36 after forming the plate material 29 through press machining and the receiver tank 2 is brazed while maintaining this state in a furnace separately from the condenser to bond the connectors 51 and 51 as an integrated part. Then, they may be linked to the condenser that has been manufactured separately, through piping.

Figure 6A:
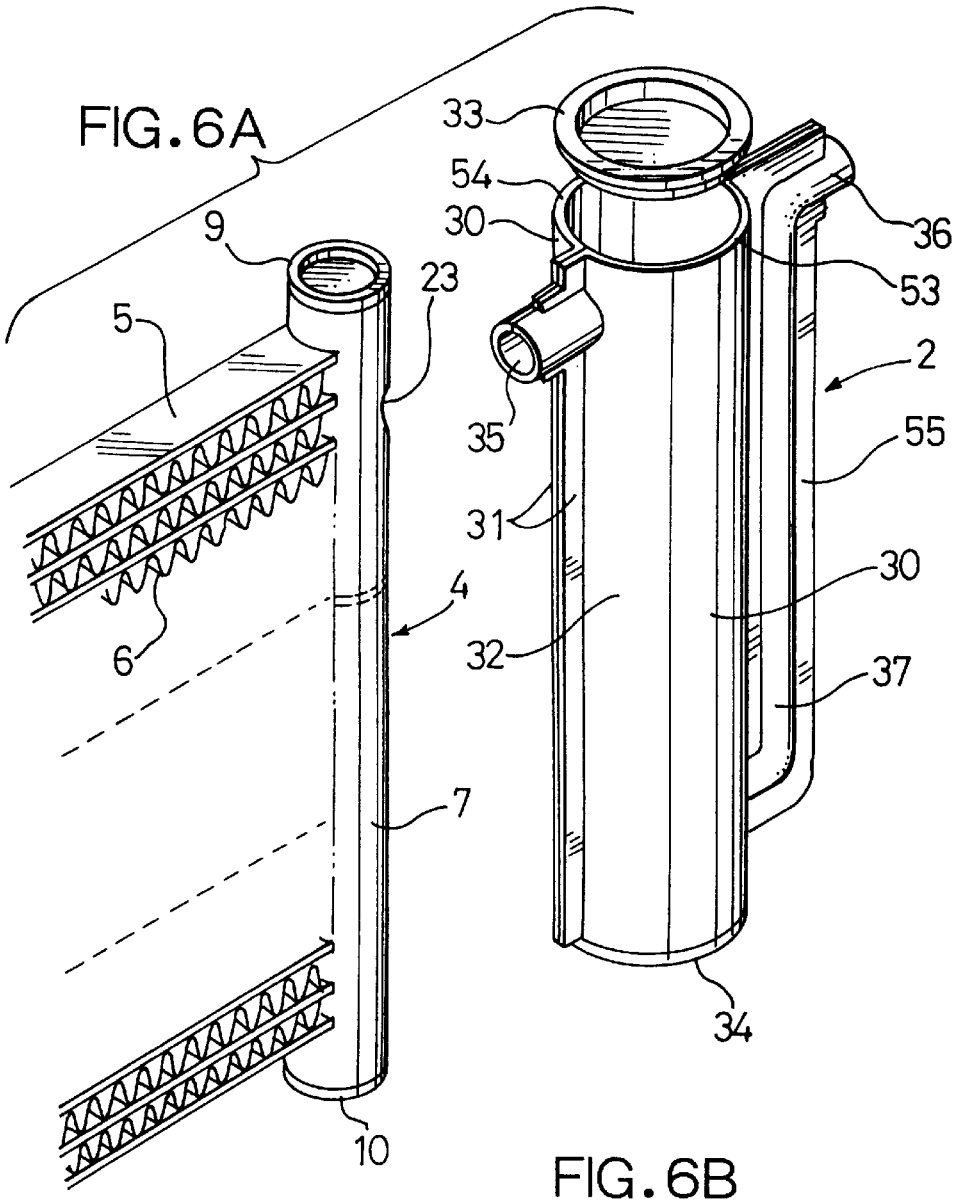
FIG. 6 illustrates a seventh structural example of the receiver tank according to the present invention, with FIG. 6A presenting a perspective illustrating a mode of mounting the receiver tank at a condenser as an integrated part and FIG. 6B illustrating the flow of the coolant through the condenser and the receiver tank.
Figure 6B:
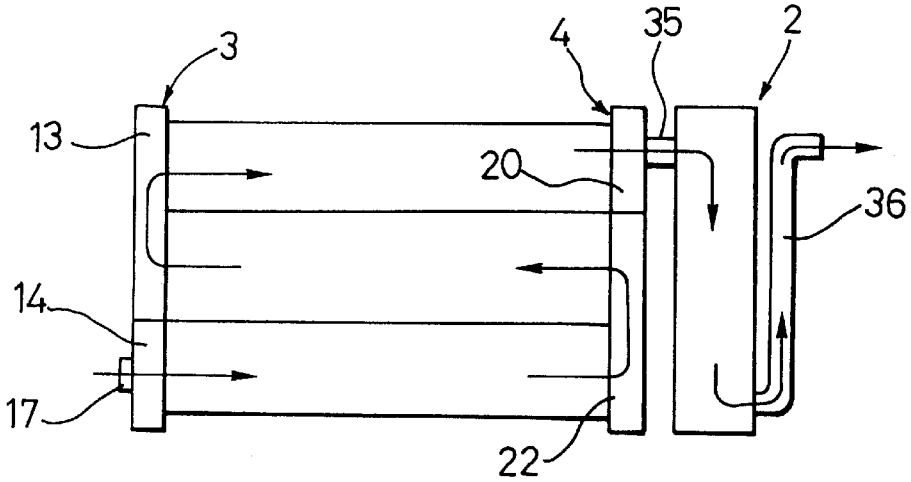

While in most of the examples described above, the condenser is provided with a main heat exchanging unit and a sub-heat exchanging unit, the receiver tank 2, as illustrated in FIG. 6, may be employed in a condenser in the prior art that is not provided with a sub-heat exchanging unit.

Namely, the receiver tank 2 may be constituted of two sheets of plate material 53 and 54, with each of the sheets of plate material 53 and 54 having a primary body wall portion 30 constituted by rolling the material in a gutter shape and bonding margin 31 and 55 extending at the two sides of the primary body wall portion 30. One of the sheets of plate material is formed symmetrical to the other sheet of plate material. These sheets of plate material, too, are formed in an integrated manner through press-forming, and the tank primary body 32 is constituted of the primary body wall portions 30 and 30 that face opposite each other when the bonding margins 31 and 55 of the two sheets of plate material 53 and 54 are abutted to each other. In addition, the coolant inflow communicating passage 35 is formed between the bonding margins 31, and the coolant outflow communicating passage 36 is formed between the bonding margins 55.

The coolant inflow communicating passage 35, which projects out toward the condenser extends from the tank primary body 32 to the upper portion of the bonding margin 31 in the radial direction and is inserted and bonded at the connecting hole 23 formed at the header tank of the condenser, whereas the coolant outflow communicating passage 36, which projects out toward the opposite side from the condenser 1 is formed to extend upward from the lower portion of the tank primary body 32. These communicating passages 35 and 36, too, are constituted between the abutted bonding margins by forming the gutter-shaped portions 37 at the bonding margins 31 and 55 by abutting the bonding margins facing opposite each other as in the structural examples explained earlier.

Figure 1B:
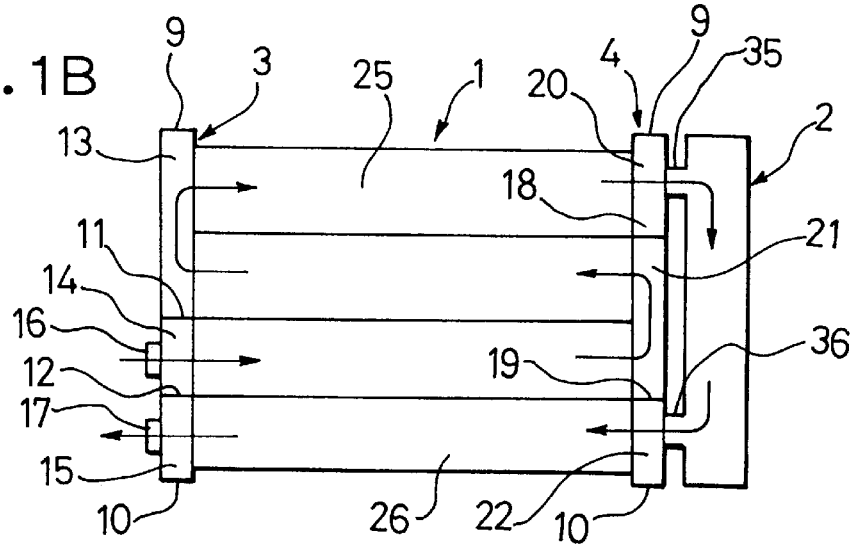

It is to be noted that in this example, the condenser does not have the third and sixth flow passage chambers that are present in the structural examples explained earlier and, although the number of flat tubes to be connected to each flow passage chamber is expected to differ, the flow of the coolant itself is identical to that in the main heat exchanging unit illustrated in FIG. 1B. In addition, since other structural features are identical to those in the previous structural examples, the same reference numbers are assigned to identical components and their explanation is omitted.

Thus, the coolant that has traveled through the communicating passage 35 from the condenser 1 and has been guided to the upper portion of the receiver tank 2 drops down within the tank primary body 32 to undergo vapor/liquid separation, and then travels through the communicating passage 36 at the outflow side to be delivered to an expansion valve (not shown). In this structure, too, the communicating passages 35 and 36 are formed together in an integrated manner by using the bonding margins 31 and 55, and furthermore, since the communicating passages 35 and 36 are formed through press machining of the sheets of plate material 53 and 54, the degree of freedom in formation can be increased as in the examples described earlier.

As has been explained, according to the present invention, since the tank primary body is constituted by abutting the bonding margins of a rolled plate material and the coolant inflow/outflow communicating passages are formed between the bonding margins, the coolant passages can be formed as an integrated part of the tank primary body simply by machining the plate material, thereby precluding the necessity for the piping or a separate member for communicating between the header pipe of the condenser and the receiver tank to achieve a simplification of the structure and a greater degree of ease in production work.

In addition, since the tank primary body and the communicating passages can be formed through press machining, the number of required manufacturing steps is smaller compared to that required in deep drawing, forging or the like employed in the prior art, greatly facilitating the machining process. Furthermore, while there is a restriction in that the communicating passages be formed at the bonding margins, the shape and the position of the communicating passages can be set freely, presenting no detraction whatsoever from the degree of freedom in receiver tank mounting configuration and also from the degree of freedom in the communicating passage layout.

What is claimed is:

1. A tank aagregate body for a receiver tank that performs vapor/liquid separation for a coolant which has been liquefied at a condenser, constituted by:

forming said tank aggregate body from a single sheet of plate material and caps:

providing a primary body wall portion constituted by rolling said single sheet of plate material in conformance to a tank primary body shape with bonding margins formed continuous to two sides of said primary body wall portion;

forming a cylindrical tank primary body from said primary body wall portion by mutually abutting said bonding margins formed at said two sides of said primary body wall portion;

closing off opening ends of said tank primary body with said caps;

forming at least one coolant communicating passage by creating at least one gap between said bonding margins that have been mutually abutted;

wherein said tank primary body and said at least one coolant communicating passage formed between said bonding margins are formed through press-forming of said single sheet of plate material.

2. A tank aggregate body for a receiver tank according to claim 1, wherein:

said bonding margins formed continuous to said two sides of said primary body wall portion are formed in areas further inside than two side edges of said single sheet of plate material, with said two side edges constituting a portion of an external wall of a header tank of said condenser and said at least one coolant communicating passage is formed between said bonding margins.

3. A tank aggregate body for a receiver tank according to claim 2, wherein:

said forming of said at least one coolant communicating passage comprises forming both a coolant inflow communicating passage and a coolant outflow communicating passage by creating gaps between said bonding margins that have been mutually abutted.

4. A tank aggregate body for a receiver tank according to claim 1, wherein:

a header wall portion constituted by rolling said plate material to form a header tank of said condenser is provided, said two sides of said primary body wall portion are provided facing opposite each other and connected to two sides of said header wall portion, and bonding margins are provided between said primary body wall portion and said header wall portion and at two side edges of said single sheet of plate material; and said at least one coolant communicating passage is formed between said bonding margins provided between said primary body wall portion and said header wall portion.

5. A tank aggregate body for a receiver tank according to claim 4, wherein:

said forming of said at least one coolant communicating passage comprises forming both a coolant inflow communicating passage and a coolant outflow communicating passage by creating gaps between said bonding margins that have been mutually abutted.

6. A tank agaregate body for a receiver tank that performs vapor/liquid separation for a coolant which has been liquefied at a condenser, constituted by:

forming said tank aggregate body from a single sheet of plate material and caps;

providing a primary body wall portion constituted by rolling said single sheet of plate material in conformance to a tank primary body shape with bonding margins formed continuous to two sides of said primary body wall portion;

forming a cylindrical tank primary body from said primary body wall portion by mutually abutting said bonding margins formed at said two sides of said primary body wall portion;

closing off opening ends of said tank primary body with said caps;

forming a coolant inflow communicating passage and a coolant outflow communicating passage by creating gaps between said bonding margins that have been mutually abutted;

wherein said bonding margins formed continuous to said two sides of said primary body wall portion are formed at two side edges of said single sheet of plate material;

wherein said coolant inflow communicating passage and said coolant outflow communicating passage are formed to project out in a direction of a radius of said tank primary body;

wherein said condenser is provided with a main heat exchanging unit and a sub-heat exchanging unit formed as an integrated unit; and wherein said coolant inflow communicating passage is connected to an outflow side of said main heat exchanging unit, and said coolant outflow communicating passage is connected to an inflow side of said sub-heat exchanging unit.

7. A tank aggregate body for a receiver tank according to claim 6, wherein:

said coolant inflow communicating passage and said coolant outflow communicating passage are respectively directly bonded at connecting holes formed at a header tank of said condenser.

8. A tank aggregate body for a receiver tank according to claim 6, wherein:

a connector for piping connection is bonded at each of said coolant inflow communicating passage and said coolant outflow communicating passage.

9. A tank aggregate body for a receiver tank that performs vapor/liquid separation for a coolant which has been liquefied at a condenser, constituted by:

forming said tank aggregate body from a single sheet of plate material and caps;

providing a primary body wall portion constituted by rolling said single sheet of plate material in conformance to a tank primary body shape with bonding margins formed continuous to two sides of said primary body wall portion;

forming a cylindrical tank primary body from said primary body wall portion by mutually abutting said bonding margins formed at said two sides of said primary body wall portion;

closing off opening ends of said tank primary body with said caps;

forming a coolant inflow communicating passage and a coolant outflow communicating passage by creating gaps between said bonding margins that have been mutually abutted;

wherein said bonding margins formed continuous to said two sides of said primary body wall portion are formed at two side edges of said single sheet of plate material;

wherein said coolant inflow communicating passage and said coolant outflow communicating passage extend so that opening ends thereof are formed close to each other;

wherein said condenser is provided with a main heat exchanging unit and a sub-heat exchanging unit formed as an integrated unit; and wherein said coolant inflow communicating passage is connected to an outflow side of said main heat exchanging unit, and said coolant outflow communicating passage is connected to an inflow side of said sub-heat exchanging unit.

10. A tank aggregate body for a receiver tank according to claim 9, wherein:

said coolant inflow communicating passage and said coolant outflow communicating passage are respectively directly bonded at connecting holes formed at a header tank of said condenser.

11. A tank aggregate body for a receiver tank according to claim 9, wherein:

a single connector for piping connection that fits with both said coolant inflow communicating passage and said coolant outflow communicating passage is bonded at said inflow communicating passage and said coolant outflow communicating passage.

* * * * *